United States Patent [19]

Wilson et al.

[11] 4,186,898

[45] Feb. 5, 1980

[54] YARN TENSION CONTROL APPARATUS OF THE BALL AND FUNNEL TYPE

[75] Inventors: Marlin V. Wilson, Barboursville, Va.; Lawrence C. Nickell, Fairlea; Larry C. Nickell, Lewisburg, both of W. Va.

[73] Assignee: Appalachian Electronic Instruments, Inc., Ronceverte, W. Va.

[21] Appl. No.: 928,571

[22] Filed: Jul. 27, 1978

[51] Int. Cl.[2] ..... B65H 59/24

[52] U.S. Cl. ..... 242/152.1; 242/147 M; 242/150 M

[58] Field of Search ..... 242/152.1, 147 R, 147 M, 242/149, 150 R, 150 M, 151, 152, 131, 131.1, 129.8

[56] References Cited

U.S. PATENT DOCUMENTS

| | | | |
|---|---|---|---|
| 1,167,636 | 1/1916 | Eastwood | 242/152.1 |
| 1,433,495 | 10/1922 | Bishop | 242/152.1 |
| 2,907,535 | 10/1959 | Mindheim et al. | 242/150 M |
| 3,040,549 | 6/1962 | Peel | 242/152.1 X |
| 3,991,954 | 11/1976 | Schwartz | 242/150 M |
| 4,095,757 | 6/1978 | Singer | 242/152.1 |
| 4,123,014 | 10/1978 | McCullough | 242/152.1 |

*Primary Examiner*—Stanley N. Gilreath
*Attorney, Agent, or Firm*—Mason, Fenwick & Lawrence

[57] ABSTRACT

A ball and funnel type yarn tension control apparatus for tensioning a running length of yarn such as textile yarn or the like, wherein a plurality of tensioning devices form a controlled channel and are controlled by an electronic control circuit having a manually adjustable tension setting potentiometer for adjusting a circuit to provide output voltages to the tension devices of the channel adding selecting tension values to the yarn. The tension control devices each comprise an electromagnet coil structure and associated core structure including pole pieces adjacent one or a pair of ball and funnel tensioning stations in each tension device to exert magnetic attractive forces on the ball member and vary tensioning of the yarn leaving the yarn tension device. Degaussing circuit means are also disclosed for applying intermittent negative going pulses to the electromagnet coils during downward adjustment of the tension setting potentiometer to minimize residual magnetic effects.

17 Claims, 10 Drawing Figures

Fig-3
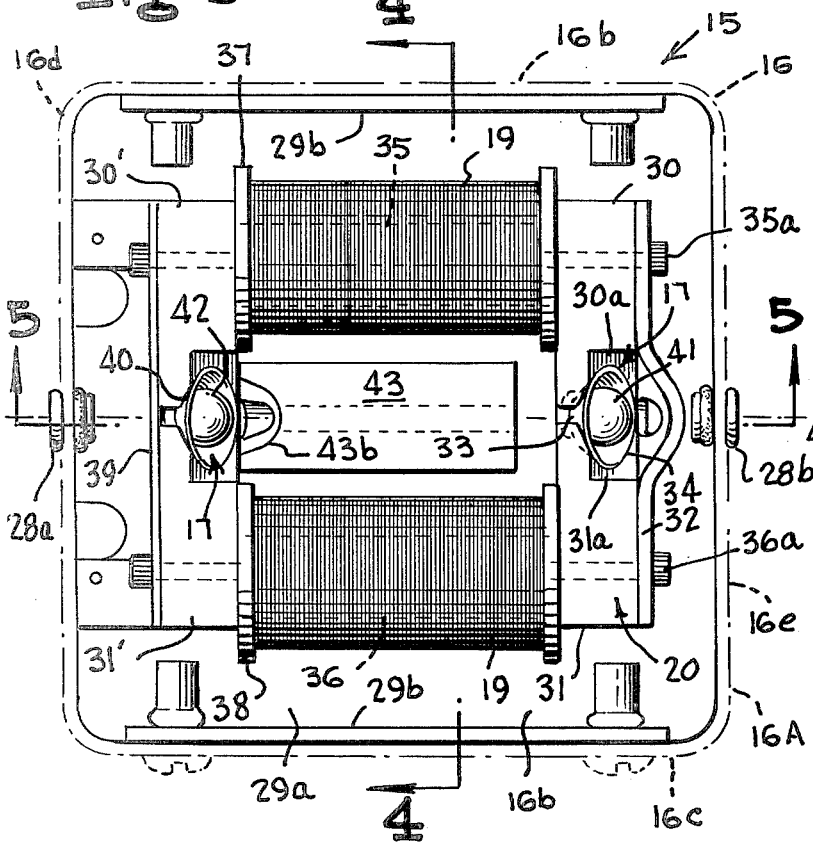
Fig-4
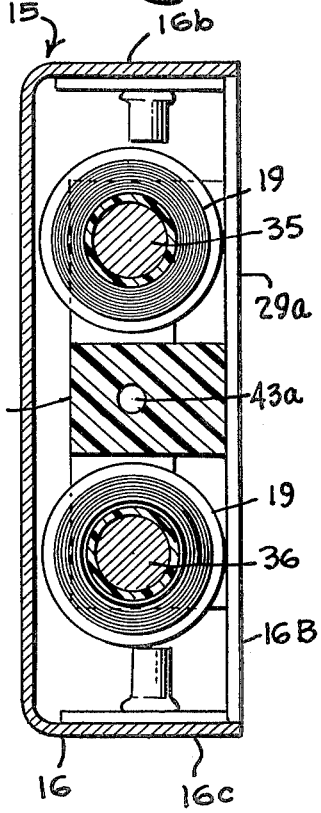
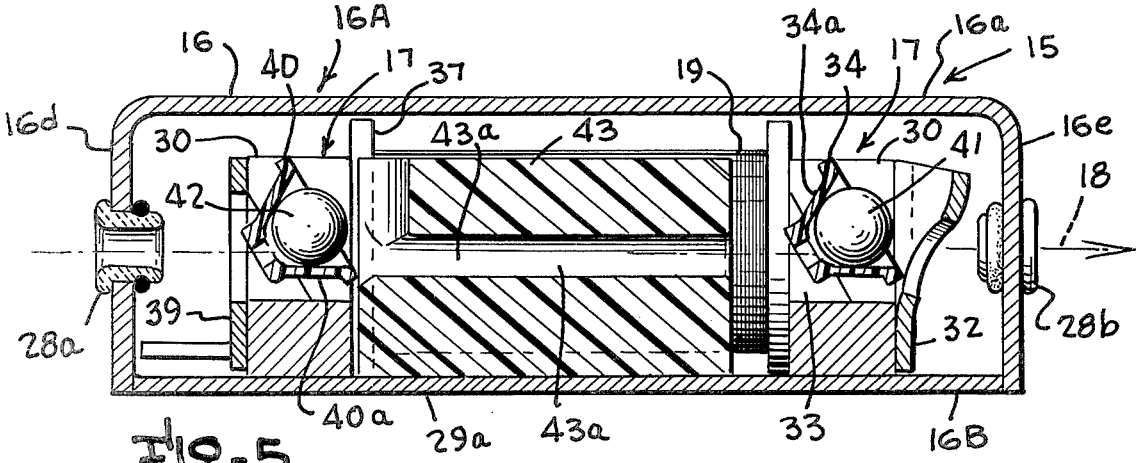
Fig-5

YARN TENSION CONTROL APPARATUS OF THE BALL AND FUNNEL TYPE

BACKGROUND AND OBJECTS OF THE INVENTION

The present invention relates in general to yarn tensioning apparatus for tensioning a running length of yarn, such as textile yarn or industrial yarn, or the like, and more particularly to yarn tension control apparatus of the ball and funnel type particularly suitable for tension control of textile yarn which is electronically controlled to exert electromagnetic tensioning forces on the yarn from a control capable of governing large groups of the units to hold a selected tension value.

There is a widespread dependence of overall quality in most textile processing on the precision or uniformity of tension of the individual yarn ends. Once yarn tension control is lost or allowed to vary at any point of the process, whether winding, beaming, texturizing, knitting or other fabric formations, the quality degeneration is difficult or impossible to compensate for. Streaking, barre, off yield, excessive knitting defects, denier variation, are familiar problems that frequently have their origin in incorrect or uncontrolled tension of the individual yarn ends.

Probably the most common type of tension device in current use is the post and disc type tensioner wherein the yarn is routed around circular posts to generate friction and build tension. The advantage of this type tensioner is its simplicity and low cost, but it has a significant disadvantage in that the tension developed by the wrapping depends on how much tension is in the yarn as it approaches the wrapped post. Since the tension in the yarn leaving such a tensioner is equal to the tension from the yarn source times a constant K determined by the wrap angle or number of posts, and the tension of the yarn going into the post and disc unit is usually uncontrolled, multiplying the supply or feed yarn tension by some factor simply makes the tension larger but still uncontrolled. For example, considering a common example involving pulling yarn from packages for warping, the supply or feed yarn tension to the post and disc tensioners may vary from ½ gram for a full package fed at 100 yards/min. as the beamer is coming up to speed after a stop to remove a slub, to 1 gram for the full package at a full beamer running speed of 500 yards/min. to 3 grams when the package is almost empty at full beamer running speed. If these variations are applied to a post and disc type tensioner which multiplies tension by some value, such as 5, then the yarn tension to the beamer would vary between 2½ and 15 grams, producing a 6 to 1 variation in tension which can cause streaks in finishing, defects in knitting, etc.

An object of the present invention, therefore, is the provision of a novel yarn tensioner apparatus of the controlled additive type which can be electronically commanded to add a certain tension value to the yarn being fed therethrough and thereby minimize the effects of uncontrolled input tension.

Another object of the present invention is the provision of a novel ball and funnel type yarn tension device having an electromagnet coil for applying tension adding magnetic forces to the ball or balls therein and wherein a plurality of such devices forming a channel are controlled by electronic circuitry which enables the tension value added to the yarn fed through the tension devices of such channel to be readily adjusted by a tension setting potentiometer to different desired values and which provides highly accurate tension control over a wide range of textile yarn tensions.

Another object of the present invention is the provision of yarn tension apparatus of the type described in the immediately preceding paragraph, wherein a plurality of the tension devices form a controlled channel and the electronic circuitry for controlling the electromagnet coils of the tension devices of such channel includes a reset circuit including degaussing circuit means for applying intermittent negative-going reset pulses to the electromagnet coil during periods when the tension setting potentiometer is being adjusted causing changes in the control voltage applied to the coils to vary tension adding values, and thus minimize residual magnetic effects during reduction in the control voltage level.

Another object of the present invention is the provision of a novel ball and funnel type yarn tension apparatus as described in the immediately preceding paragraph, wherein a flag or graduated light mask on a pivoted arm is positioned by the yarn leaving the tension devices to indicate the tension value of the leaving yarn and light sensing means and associated circuitry is provided to vary magnetic forces applied to the ball or balls to enable the leaving tension value to be maintained at a substantially constant level.

Other objects, advantages and capabilities of the present invention will become apparent from the following detail description, taken in conjunction with the accompanying drawings showing preferred embodiments of the invention.

BRIEF DESCRIPTION OF THE FIGURES

FIG. 3 is a top plan view of the tension control device with the side and end walls of its case shown in broken lines;

FIG. 4 is a vertical longitudinal section view thereof, taken along line 4—4 of FIG. 3;

FIG. 5 is a horizontal section view, taken along the line 5—5 of FIG. 3;

DETAILED DESCRIPTION OF PREFERRED EMBODIMENTS

Figure 1:
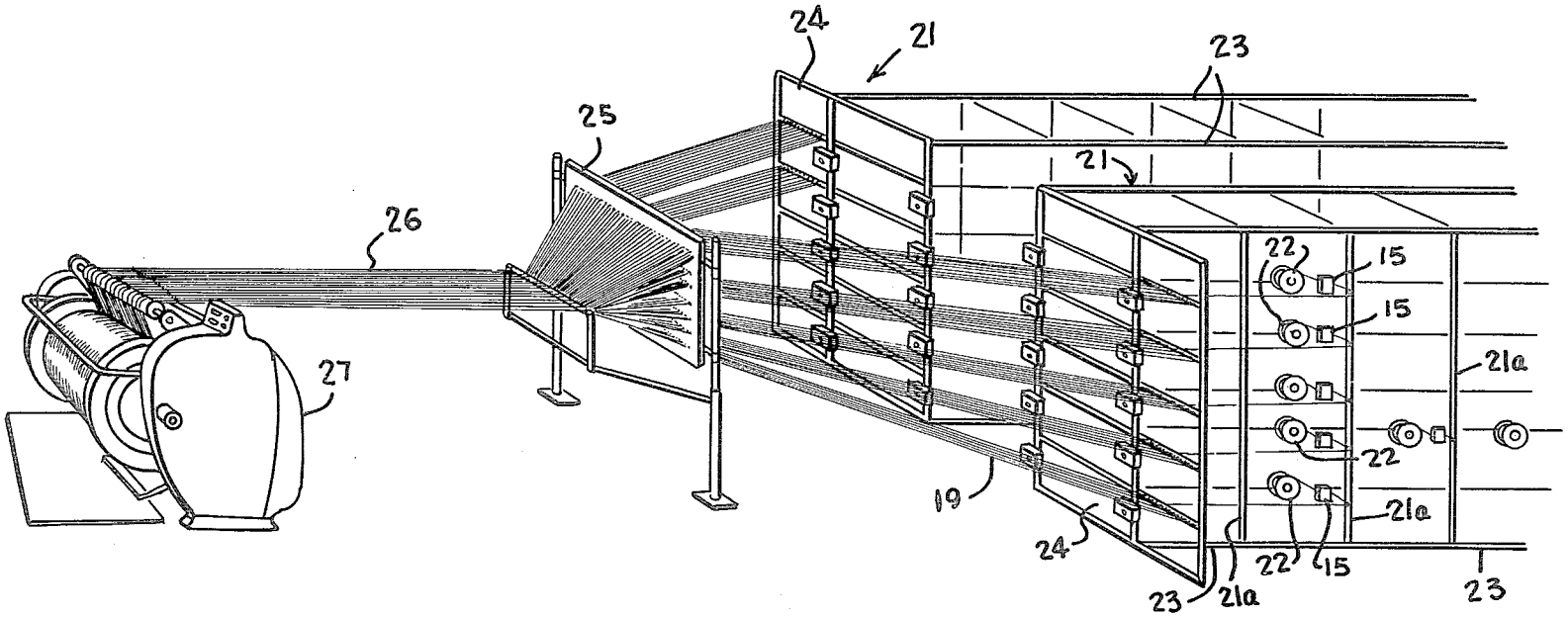
FIG. 1 is a somewhat diagrammatic persepective view of a typical creel and warper installation having yarn tension control devices of the present invention for regulating yarn tension to the warper.
Figure 2:
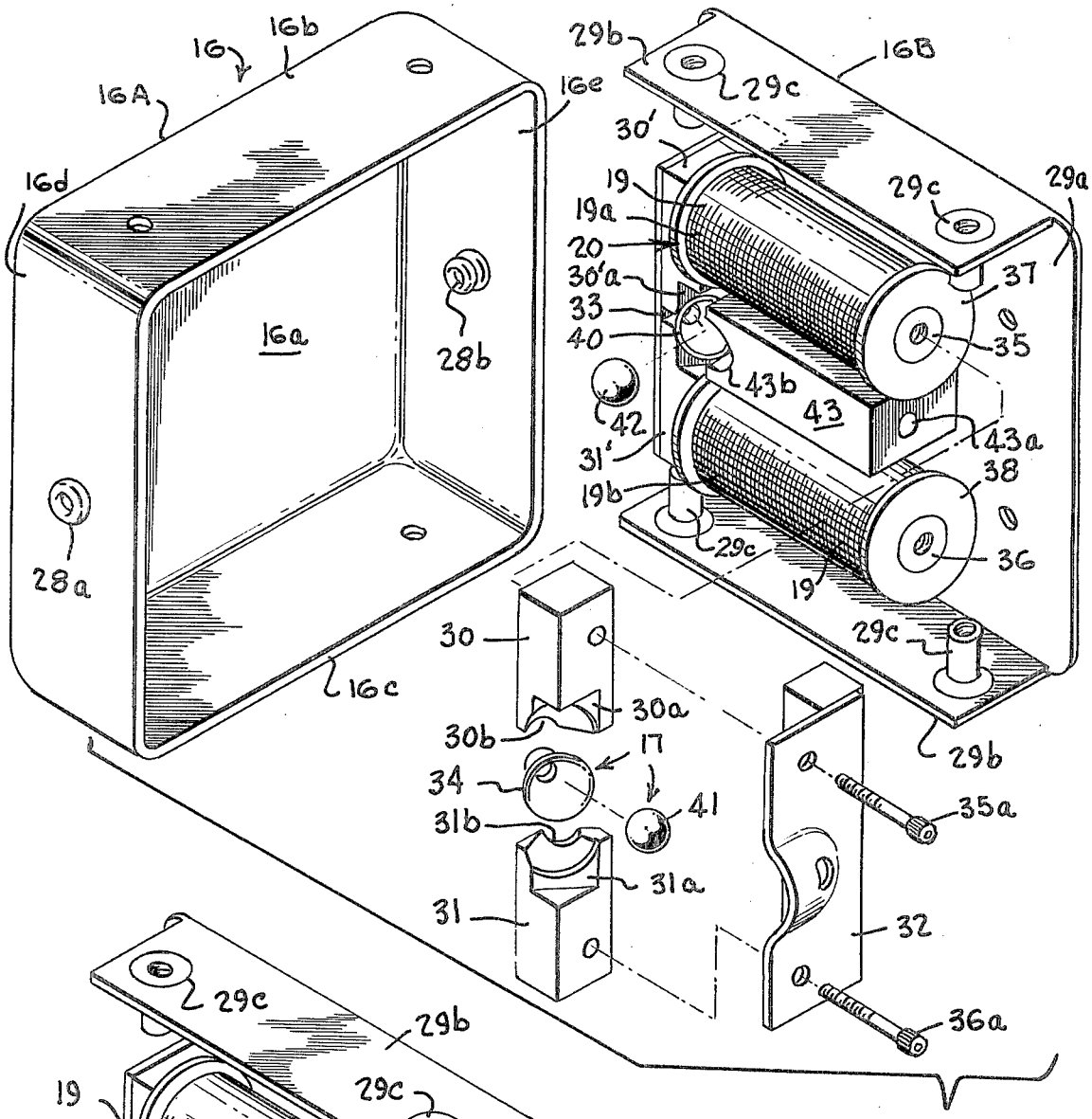
FIG. 2 is a perspective view of the interior mechanism of the yarn tension control device exploded from its associated case.

Referring to the drawings, wherein like reference characters designate corresponding parts throughout the several figures, and particularly to FIGS. 1 to 5, a preferred form of the yarn tension control apparatus of the present invention is indicated by the reference character 15 and comprises a case or housing 16, formed of two sections including a generally rectangular box shaped cover section 16A and a base section 16B having a pair of side flanges to be telescopically interfitted in the cover section. The pair of case sections 16A,16B house one or a pair of ball and funnel assemblies 17 through which the yarn 18 to be tensioned is threaded as well as associated electromagnet coils 19 and core components 20 to apply controlled magnetic forces to each ball attracting it toward its associated funnel with appropriate force to add the desired tension value to the yarn 18. In a typical installation, a number of such yarn tension control units 15 equal to the number of yarns 18 being drawn from a creel assembly 21, shown fragmentarily in FIG. 1, for example 1050 yarns in a 1050 end creel, are mounted on the vertical post members **21*a* of the creel at the locations where the yarn ends leading from the yarn packages 22 exit from the creel framework 23 to be redirected through the eyelets of the separator panels 24 and eyeboard 25 and form the yarn sheet 26 being drawn onto the warper or beamer 27. Each yarn end 18 from the packages 22 is drawn through its own associated tension control unit 15 so that the tension of the respective yarn ends issuing therefrom can be set to the desired value to maintain substantially uniform tension on all the yarns being wound on the warper 27 whether the packages 22 are full or near empty and whether the warper 27** is operating at full speed or at some intermediate speed during start up after a stop. It will be appreciated that the yarn tension control device can be used in many other applications, as to provide yarn tension control for each yarn end leading to a circular knitting machine to provide control and variation of pattern, texture, uniform tension or tension control for pattern effects and the like.

The embodiment of the yarn tension control device 15 illustrated in FIGS. 1 to 5 has a pair of ball and funnel assemblies 17 arranged serially along the yarn path therethrough. Its cover section 16A has a generally rectangular wall **16*a* bounded by a pair of side walls 16*b*,16*c* and inlet and outlet end walls 16*d*,16*e* formed as flange-like edges of the wall 16*a*. The inlet and outlet end walls 16*d*,16*e* each have a yarn passage opening therethrough in which inlet and outlet eyelets 28*a*,28*b* are fitted to receive the yarn. The base section 16B has wall member 29*a* similar in size and shape to the wall 16*a* which supports the electromagnet and ball and funnel assemblies and is provided with side flanges 29*b* and shaped to fit into and be fastened within the cover section 16A by fasteners extending through the side walls 16*b*,16*c* into socket members 29*c* in the side flanges 29*b* which inwardly lap the sides 16*b*,16*c* of the cover section 16A. Fixed on the base section 16B are a first pair of companion pole pieces 30,31 shaped as illustrated in the drawings, held in proper alignment and spacing by a straightener or aligning strap 32 and spaced apart to define a gap 33 therebetween and each having an inclined wall inset 30*a*,31*a* formed in the mutually adjacent end portions with truncated conical well sectors 30*b*,31*b* cut out of the inclined wall insets to collectively define a properly shaped seat or well for a ceramic funnel 34 to be seated therein. The pole pieces 30,31 are formed of steel having low magnetism retention properties in the preferred embodiment, and are assembled onto cylindrical core pieces 35,36 by threaded metallic screws 35*a*,36*a*** to help the magnetic flux get into the core pieces.

The core pieces 35,36 extend along parallel axes through plastic spools 37,38 wound with "magnet" wire, such for example as about 6000 turns of #36 copper wire, to form the electromagnet coils **19*a*,19*b*. The ends of the pole pieces 30,31 nearest the inlet end wall 16*d* are assembled in the tandem ball and funnel version to a pair of companion pole pieces 30',31' held in properly aligned and spaced position like the pole pieces 30,31 by a straightener or aligning strap 39 and having inclined wall insets 30*a*',31*a*' interrupted by truncated conical recesses 30*b*',31*b*' similar to those of pole pieces 30,31 to receive and support a second ceramic truncated conical funnel 40. Positioned in each of the funnels 34,40, are similar spherical metallic balls 41,42, which are to be attracted toward the smaller diameter apertured ends of the respective funnels 34,40 by magnetic forces determined by the electrical current level flowing through the coils 19*a*,19*b* of the electromagnet. Between the ball and funnel assemblies is a plastic guide block 43, for example of rectangular configuration having a length to extend the major portion of the distance from the inlet end of the electromagnet spools to a position near but spaced just toward the inlet from the outlet end of the spools, having a central bore 43*a* forming a guide tunnel to receive and guide a threading tool for inserting the yarn 18 between the inlet and outlet ball and funnel assemblies without appreciable frictional restraint on the yarn while facilitating threading of the yarn through the tensioning device. As will be observed from FIG. 3, the end of the plastic guide block 43 nearest the inlet end of the yarn tensioning device is provided with a concave socket 43*b* of near semicircular cross-section in the section plane paralleling the mounting base 29 and which extends along a curved path opening through the uppermost face of the guide block, assuming the tensioning device to be disposed horizontally, in a typical beamer creel assembly installation, to loosely capture the ball 42 in the funnel 40, and this as well as the curved portion of strap 32 serve to avoid the balls getting lost or displaced during shipping or handling. The configuration of the socket 43*b* and of the curved portion of the straightening and aligning strap 32 are such as to permit the balls 41 and 42 to be gravitationally released from their associated funnels when the tensioner is placed in an inverted position with the mounting base disposed uppermost and the housing or case member 16 removed from mounting base 29 so that the wall 16*a*** of the case no longer coacts to restrain the balls in their associated funnel and socket spaces.

The yarn tension control unit 15 is mounted, in use, so that one surface of the cone portion **34*a*,40*a* of the funnel or funnels 34,40 is flush with the yarn path, as illustrated in FIG. 5. Thus, in a beamer creel installation, the units are positioned so that the base section 16B** of each unit is in a horizontal plane. In this way, the yarn does not tend to lift up the ball as the existing yarn tension increases and cause the tensioner to tend to become a multiplier type, as would be the case if the yarn path were oriented to cause the ball to lift from the funnel surface as tension increases. With the funnel surface oriented flush with the yarn path, the present tension control unit is additive because the ball or balls merely add tension as a function of the setting of electrical system supply to the coils and tends to wash out the source tensions.

Figure 6:
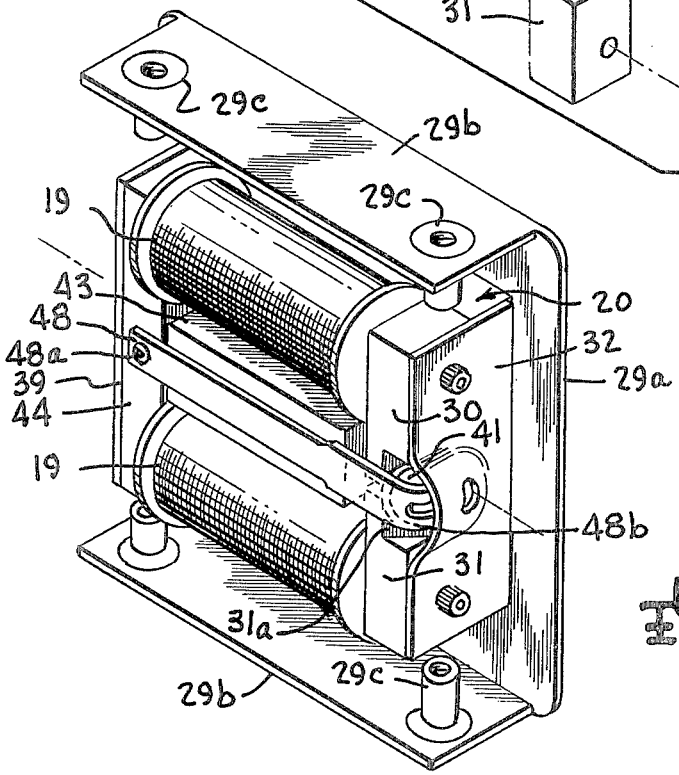
FIG. 6 is a perspective view of a modified tension device having only one ball and funnel, with the cover removed.

In certain applications, such as for use as yarn tensioners for circular knitting machines, which only need up to about 10 grams added tension, or for use on Trico knitting machines which only require tension up to about 20 to 25 grams, the yarn tensioning apparatus may provide adequate tension range with only one ball and funnel assembly, permitting a less expensive but highly effective yarn tension control device to be marketed for these applications. In such a case, the construction of the yarn tensioning apparatus having only one ball and funnel assembly is illustrated in FIG. 6, and contains for the most part components similar to those of the two ball and funnel version of FIGS. 1 to 5, in which case the reference characters used in FIG. 6 are the same as those used for corresponding components of the two ball and funnel arrangement. In the single ball and funnel version, the housing 16 is of the same configuration and construction as for the previously described two ball and funnel version, providing inlet and outlet eyelets 28*a*,28*b* in the end walls 16*d*,16*e*. The single ball and funnel version includes the same companion pole pieces 30,31 fixed in proper alignment and spacing by the straightener or aligning strap 32 to define the gap 33 therebetween forming collectively by the conical well sectors 30*b*,31*b* cut out of the inclined wall insets 30*a*,31*a* providing the seat for the ceramic funnel 34 in which the metallic ball 41 is positioned. Core pieces 35,36 are fastened to and extend from the companion pole pieces 30,31 through the plastic spools 37,38 wound with magnet wire to form the electromagnet coils 19*a*,19*b*. The ends of the pole pieces nearest the inlet end wall 16*d* are assembled to a single pole piece 44, which is generally of the same cross-sectional size and total length as the pole pieces 30',31' of the first described embodiment, but which simply has a hole for passage of the yarn instead of the carefully shaped inclined wall insets and truncated conical well sectors of the pole pieces 30,31 since there is no ball and funnel assembly to be mounted at the inlet end of the electromagnets. The yarn 18 is simply led from the inlet end eyelet 28*a* through the hole in the pole piece 44 and the yarn then passes through the plastic guide block 43 in the same manner as in the previous version to the gap 33 between the pole pieces 30,31 and through the opening 34*a* in the smaller or base end of the ceramic truncated conical funnel 34 and flush alongside the surface 34*b* thereof between the surface 34*b* and the metallic ball 41, and thence through the outlet eyelet 28*b*.

It may be desirable in the single ball and funnel version of FIG. 6 to provide some means for releasibly restraining the ball 41 against accidental dislodgement from its associated funnel 34 when the cover is removed from the mounting base. This can be accomplished in the manner illustrated in FIG. 6, by providing an elongated holding strap 48, preferably of beryllium copper so as not to affect the magnetic properties of the device, fixed at its anchored end adjacent the inlet end pole piece 44 to the plastic block as by screws 48*a*. The other or outlet end portion of the holding strap 48 is curved inwardly toward the base wall 29*a* of the mounting base 29, as indicated at 48*b*, and is forked over part of the curved end portion 48*b* to lie close to the ball 41 and restrain it in captured condition in its associated funnel 41. The strap 48 can be manually flexed away from the funnel 34 when desired to release the ball 41 from funnel 34.

Figure 7:
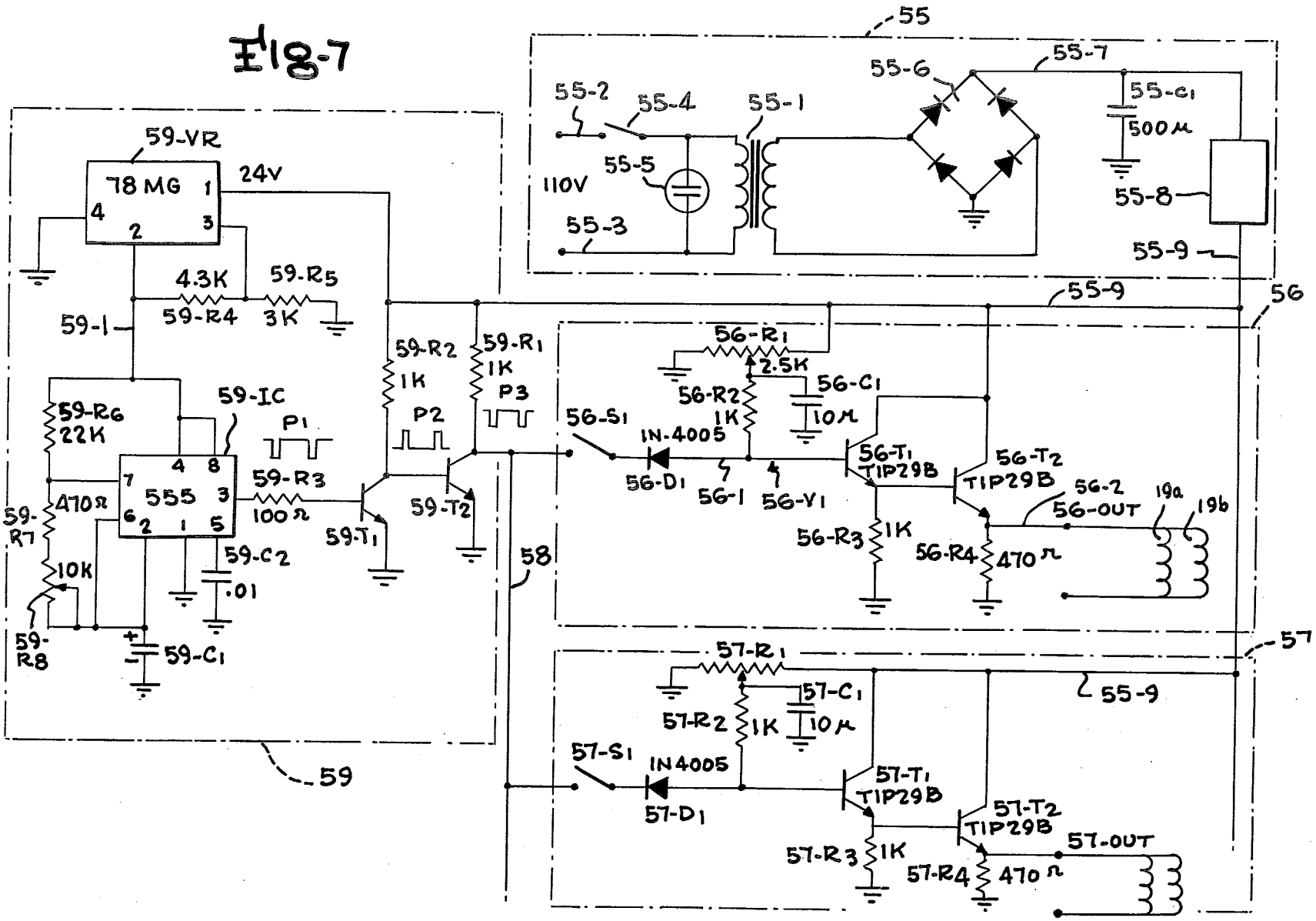
FIG. 7 is a schematic diagram of an electronic control system for manual adjustment control of the yarn tension control devices, showing only two control channels of a multichannel control system.

FIG. 7 illustrates in schematic diagram form an electronic control system for remote manual adjustment control of a bank of the yarn tension control devices. Although only two control channels of a multichannel yarn tension system are illustrated in FIG. 7, it would be appreciated that the yarn tension control devices of either the type illustrated in FIGS. 1–5 or of the type illustrated in FIG. 6 may be arranged in a plurality of groups of a number of such tension control devices, with the plurality of tension control devices of each individual group controlled by the tension control signals from a single respective one of the channels of the electronic control system. Referring particularly to FIG. 7, there is shown a power supply circuit generally indicated at 55 which includes a step-down transformer 55-1 for stepping down a nominal 110 volt supply to 24 volts across its secondary winding. The primary winding of the transformer 55-1 is connected by supply leads 55-2, 55-3, to a nominal 110 volt supply, and is provided with a master on-off switch 55-4 in one of the supply leads as shown, as well as having a power indicator lamp 55-5 across the primary supply leads to indicate when power is on. The leads from the secondary winding of the transformer 55-1 are connected across opposite corners or input terminals of a rectifier bridge 55-6 formed of four rectifier diodes connected as shown. The other pair of corners or output connections of the rectifier bridge 55-6 are connected to ground and to the top of a capacitor 55-C1, for example a 500 μf capacitor connected to ground, providing 24 volts DC unregulated at the output lead 55-7. This lead is connected to a conventional voltage regulator 55-8, for example by connecting it to the collector of a 2N3055 regulator transistor. The output from the voltage regulator 55-8 provides the regulated 24 volts DC supply on the lead 55-9 forming the main supply to each of the tension control channels, two of which are indicated generally by the reference characters 56 and 57.

Referring specifically to the circuitry of tension regulator channel #1, indicated at reference character 56, each control channel comprises a Darlington emitter follower pair formed of a transistor such as transistors 56-T1 and 56-T2, each of which may be, for example, a TIP29B, connected as shown, with their collectors connected to the regulated 24 volt supply lead 55-9 and their emitters connected through resistors 56-R3 and 56-R4 to ground. The gate of transistor 56-T2 of the Darlington pair is connected to the emitter of transistor 56-T1, and the gate of transistor 56-T1 is connected through lead 56-1 through a silicon diode 56-D1, for example, a 1N4005, and through a normally off push-button switch 56-S1 to a main reset led 58 from a degaussing reset circuit generally indicated at 59. The lead 56-1 between the silicon diode 56-D1 and the first transistor 56-T1 of the Darlington pair is connected through resistor 56-R2 to the wiper of the main tension control potentiometer 56-R1 connected between ground and the regulated 24 volt supply lead 55-9. The resistor 56-R2 may be a 1K resistor and the potentiometer 56-R1 a 2.5K resistor, and a capacitor 56-C1, for example, a 10 μf capacitor, is connected between the wiper and ground. The output voltage to be supplied to the electromagnet coils 19*a*, 19*b* of the group of yarn tension devices 15 connected to the respective channel, for example, channel 56, are connected to the output lead 56-2 at terminal 56-out which applies the voltage at the top of the emitter resistor 56-R4 of transistor 56-T2 to each of the electromagnetic coils. By use of the Darlington emitter-follower circuit, very little current is removed from the potentiometer 56-R1 and the load current is independent of the setting of the potentiometer, so that adding other tension devices to the channel does not pull the voltage down further.

It has been found that one can put at least a half dozen yarn devices on each channel or group control output terminal such as 56-out or 57-out using a TIP29B for each of the Darlington pair transistors 56-T1 and 56-T2 without generating too much heat. In the described example, with the control potentiometer 56-R1 set at the bottom or grounded end, approximately 0 volts is applied to the base of the transistor 56-T1, while setting the wiper of potentiometer 56-R1 at the top or opposite end provides approximately 24 volts at the wiper and at the base of the transistor 56-T1 and approximately 23.5 volts at the emitter of transistor 56-T1. If the potentiometer 56-R1 is set to provide about 10 volts at the bottom of resistor 56-R2, a voltage level of about 9.5 volts is produced at the emitter of transistor 56-T1 (or at the top of resistor 56-R3) and about 9.0 volts is provided at the emitter of transistor 56-T2.

It will be noted in FIG. 7 that the corresponding circuit components of channel #2, indicated generally at 57, are designated by reference characters beginning with the numeral 57, instead of the numeral 56, but otherwise corresponding to the reference characters used in connection with channel 56.

The degaussing reset circuit indicated generally at 59 comprises an integrated circuit voltage regulator, indicated at 59-VR, which may be a Motorola 78MG Integrated Circuit, having the 24 volt regulated supply from the lead 55-9 applied to pin 1 of the integrated circuit 59-VR. Resistor 59-R4 is connected between leads from pins 2 and 3 of integrated circuit 59-VR and resistor 59-R5 is connected between pin 3 and ground. 12 volts regulated supply is provided by the lead 59-1 from pin 2 of 59-VR to pins 4 and 8 of a pulse generator integrated circuit 59-IC, which may be a National Semiconductor 555 Integrated Circuit, and is also applied to one end of resistor 59-R6 connected in series with resistor 59-R7 and potentiometer 59-R8, the latter serving as a pulse width adjustment. A lead connects from between the resistors 59-R6 and 59-R7 to pin 7 of 59-IC, pin 2 of 59-IC is connected through capacitor 59-C1 to ground and also to the wiper and lower end of the potentiometer 59-R8, and pin 5 is connected through capacitor 59-C2 to ground. Pin 3 is connected through resistor 59-R3 to the base of transistor 59-T1, whose emitter is connected to ground and whose collector is connected through resistor 59-R2 to the 24 volt regulated supply lead 55-9. The collector of transistor 59-T1 is also connected to the base of transistor 59-T2 whose emitter is connected to ground and whose collector is connected through resistor 59-R1 to the 24 volt supply lead 55-9 and also is connected to the main reset lead 58 extending to each of the tension regulator channels 56,57, etc. With integrated circuit 59-IC wired as shown, the 10 K pulse width adjustment potentiometer 59-R8 provides width adjustment for short duration pulses at output pin 3, while the 220 K resistor 59-R6 sets the period of the square wave output produced by 59-IC. This output square wave pulse pattern is inverted and amplified to a 24 volt pulse level by transistor 59-T1 and is inverted and the current content increased by transistor 59-T2 to provide the reset pulses applied to the main reset lead 58.

In the operation of the degaussing circuit, the pulse generator integrated circuit 59-IC typically generates negative pulses of about 40 milliseconds width with typically about one second between successive negative pulses. Considering the operation of the circuit, the first pulse, in the waveform indicated at P1 above resistor 59-R3 in FIG. 7 turns the transistor 59-T1 on, saturating the transistor, which serves to invert the pulse, as indicated at P2 in the waveform indicated for the base of transistor 59-T2, and squares up the waveform and raises the pulse level to about 24 volts. This positive pulse P2 is inverted through transistor 59-T2 and made more powerful, and is applied to the main reset lead 58 as a train of negative pulses as indicated at P3.

When the operator pushes the reset button 56-S1, 57-S1, etc. for any of the tension regulating channels 56,57, or other control channels, to change the tension setting of the group of tension control devices 15 regulated thereby to a lower tension value, the plus 24 volt portion of the reset pulse waveform illustrated at P3 is applied to the base of the first transistor of the Darlington emitter-follower pair for the associated control channel, for example the transistor 56-T1 when the reset switch 56-S1 is closed, but this portion of the reset pulse waveform does nothing because the diode 56-D1 is back biased, with its cathode at a greater positive potential than its anode. However, when the short zero voltage portion of the reset pulse waveform P3 occurs, this is applied through the reset switch 56-S1 to the cathode of diode 56-D1, causing the base of transistor 56-T1 to go negative to close to zero volts, dragging the emitter of transistor 56-T1 and the base of transistor 56-T2 down to almost zero and thus making the voltage level at the output terminal 56-out and lead 56-2 to near zero for about 40 milliseconds. Then the next 24 volt positive pulse of the reset waveform P3 occurs, raising the base of transistors 56-T1 and 56-T2 to a new lower voltage level for a new tension setting. For example, considering the voltage at point 56-V1 applied to the base of transistor 56-T1, if one is reducing the tension of the yarn leaving the controlled tension devices 15 regulated by channel 56 from 9 grams to 7 grams, requiring reduction of the voltage at point 56-V1 from about 10 volts to about 8 volts respectively, the voltage at point 56-V1 and at the base of the transistors 56-T1 and 56-T2 and at the output terminal 56-out is caused to momentarily go negative to close to zero during the 40 milliseconds short zero voltage portion of pulse waveform P3 and then rises after each short zero voltage portion in the reset waveform to a lower voltage setting decending from the previous 10 volt level as the knob of the potentiometer 56-R1 is adjusted for lower voltages and tensions. By having the voltage level intermittently interrupted and then rising to a new lower setting, rather than having the voltage simply reduce progressively from the higher to the lower level, residual magnetism effects are eliminated.

Instead of using the degaussing circuit and power supply of FIG. 7 wherein the degaussing pulses merely go to a zero voltage level before rising again to the voltage level being set by the tension control potentiometer (such as 56-R1), a degaussing circuit such as that disclosed in our companion patent application Ser. No. 928,572 filed July 27, 1978 and entitled YARN TENSION CONTROL APPARATUS OF THE YARN WEAR SHOE TYPE, schematically indicated at FIG.

7 in that application, may be employed with the yarn tension devices and control channels of this application, in which case the negative going degaussing pulses go to a predetermined negative voltage level, usually to about minus 2 or 3 volts, instead of going to zero, to even more effectively washout or remove any residual magnetism in the yarn tensioning device during the occurrence of each degaussing pulse.

Figure 8:
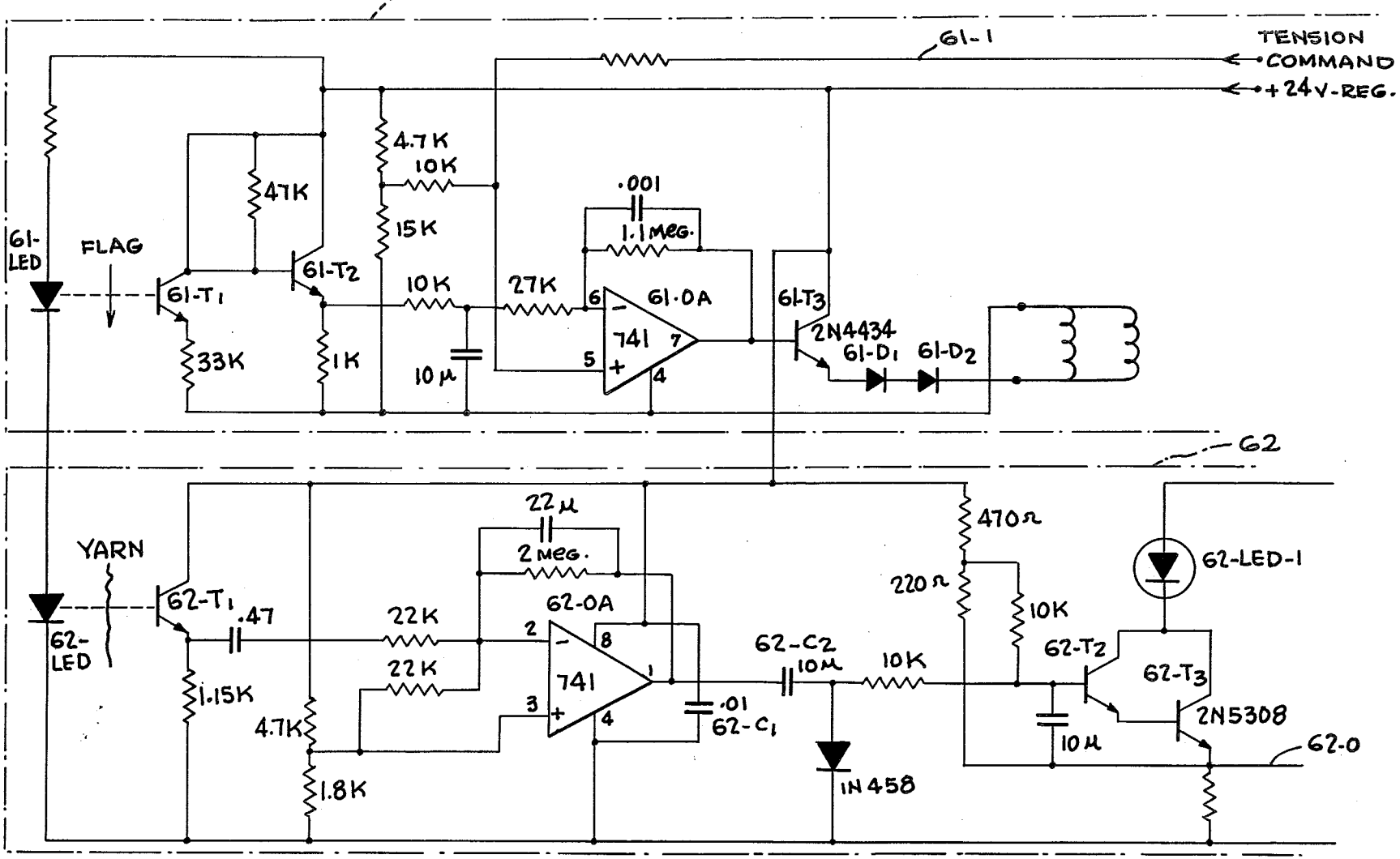
FIG. 8 is a schematic diagram of an electronic control system for use with a modified form of the yarn tension control device having an automatic tension regulating flag device varying tension in predetermined relation to light intensity variations produced by the flag device.
Figure 10:
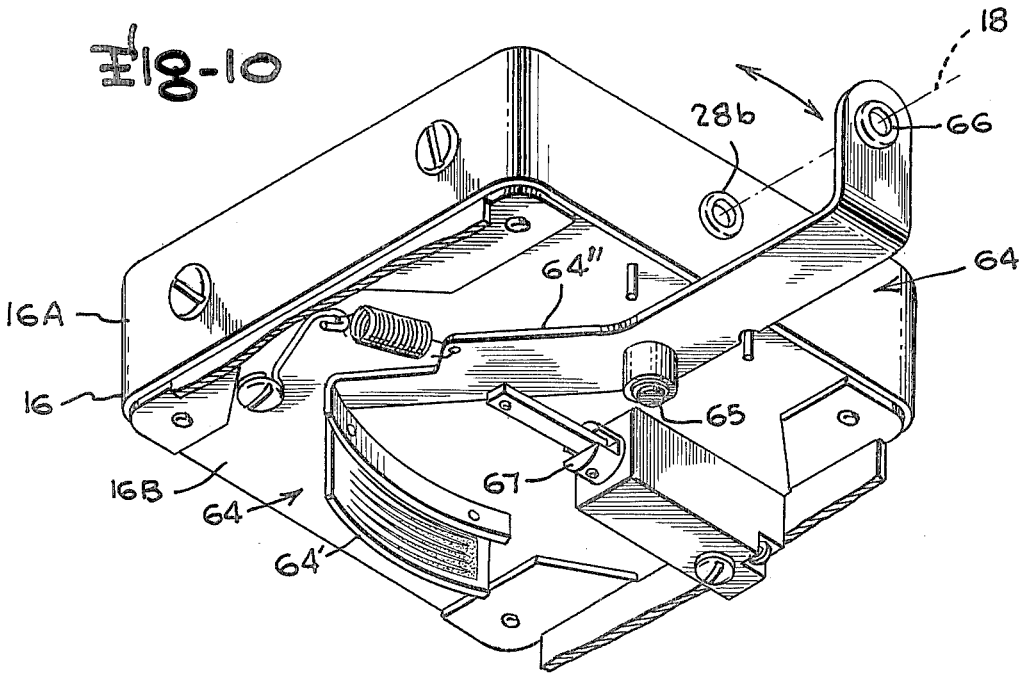
FIG. 10 is a fragmentary perspective view of a light intensity varying flag or mask and supporting arm for the modified yarn tension control device of FIG. 8.

Referring now to FIG. 8 disclosing a schematic diagram of a modified electronic control system for use with a yarn tension control device having the light intensity varying flag of FIG. 10 for automatic control of the tension applied to the yarn leaving the yarn tension device, there is illustrated in FIG. 8 in the upper portion, generally indicated by the reference character 61, a circuit for use with the automatic tension regulating flag device illustrated at 64 in FIG. 10 associated with the tension device otherwise corresponding to the tension device 15 of FIGS. 1–5. This device additionally includes electronic circuitry on a printed circuit panel supported from the housing 16 by posts, and having the flat 64 in the form of a arcuate light transmitting panel 64' forming a graduated light transmission mask fixed on the pivoted supporting arm 64'' pivoted on post 65 and having a yarn eye 66 through the yarn passes leaving the tension device to cause displacement of the flag in predetermined correlated relation with increase or decrease of the tension of the leaving yarn. The flag arm 64'' is damped by a damping piston 67 and the flag device 64' is interposed between a light source such as a light emitting diode, indicated by the reference character 61-LED, and a phototransistor indicated by reference character 61-T1. The voltage at the emitter of the phototransistor 61-T1 reduces as the tension of the leaving yarn passing through the yarn eye 66 reduces, as the graduated light transmission properties of the flag or mask 64' are such that minimum transmission occurs at zero tension and transmission increases as tension increases.

Figure 9:
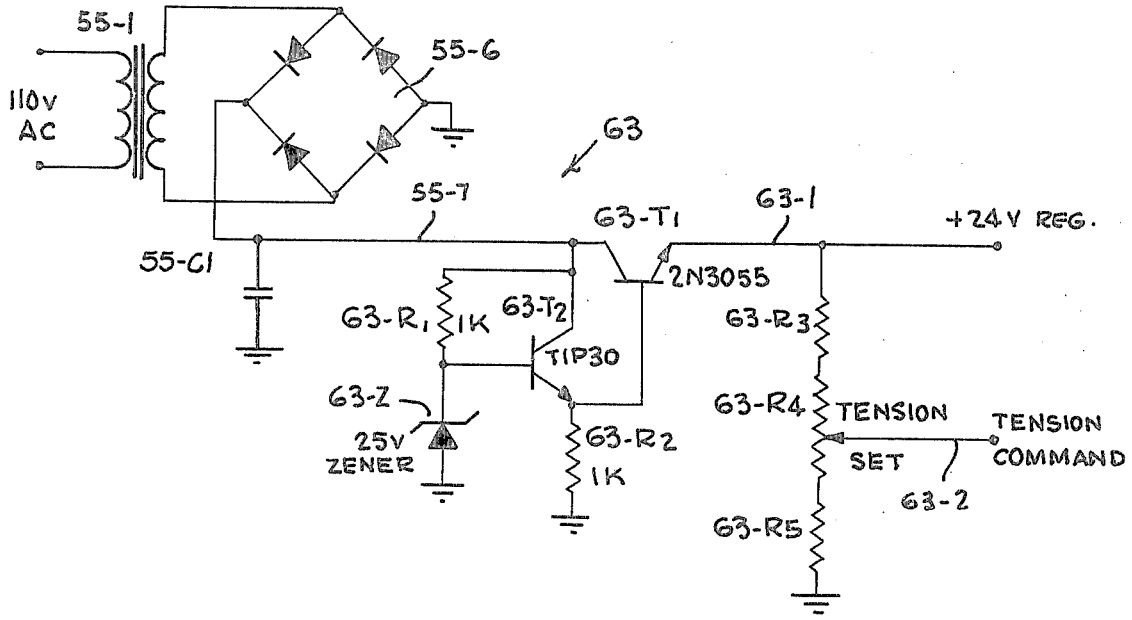
FIG. 9 is a schematic diagram of a circuit suitable to provide regulated power supply voltages and command signals to the yarn tension control circuitry of FIG. 8.

The signal voltage produced at the emitter of the phototransistor 61-T1 occurring as a consequence of the position of the flag or mask 64' is applied to the base of the emitter-follower transistor 61-T2 to beef up the signal power, and this is applied through resistors to the negative polarity input at pin 6 of operational amplifier 61-OA, which may be a National Semiconductor 741 Operational Amplifier. A tension command signal level applied through input lead 61-1 from the tension set control potentiometer 63-R4 of the power supply and command signal source 63 of FIG. 9 is supplied to the positive polarity input of the 741 Operational Amplifier 61-OA. The Operational Amplifier 61-OA is connected in the manner shown to provide feedback so that the gain is stabilized at the desired gain value, and the operation is such that if the negative input from transistor 61-T2 differs from the negative command voltage from lead 61-1 on the positive polarity input to the Operational Amplifier 61-OA, the Operational Amplifier 61-OA provides an output signal, which is beefed up in current content through the emitter follower 61-T3 and is applied through diodes 61-D1 and 61-D2 to the drive coils of the tension devices 15 to adjust the tension imposed on the leaving yarn by the balls of the tension devices to maintain tension constant at the preset value determined by the tension command signals on leads 61-1.

Also, the circuit shown in FIG. 8 includes in the lower portion a stop motion circuit generally indicated at 62 to allow continued operation of the beamer so long as noise signals are produced resulting from yarn flutter produced by yarn passing through the eyelet at the inlet end of the yarn tension device, and which activates the stop control for the beamer to stop the beamer whenever this noise signal arising from yarn flutter ceases. As indicated in the schematic circuit in the stop motion portion 62 of FIG. 8, yarn passes through the space between the light source formed by light emitter diode 62-LED and the light detecting phototransistor 62-T1, for example by mounting them in notches on the mounting bracket adjacent the inlet eyelet **28*a* of the yarn tensioning device 15, disposed so that yarn flutter of the yarn going in interrupts the light. The phototransistor 62-T1 may be, for example, an L14B General Electric Transistor. The variable voltage produced at the emitter of the phototransistor 62-T1 as a result of the fluttering yarn passing between it and the light source 62-LED is applied to the negative polarity input pin No. 2 of Operational Amplifier 62-OA, which may also be a National Semiconductor 741 Operational Amplifier, connected to provide feedback as shown so that the gain is stabilized at some desired value, for example a gain of about 100. The output from the Operational Amplifier 62-OA is passed through the capacitor 62-C2, which converts the "noise signal" resulting from yarn flutter into a "DC offset signal", which is applied to the base of the first transistor 62-T2 of a Darlington pair 62-T2 and 62-T3, the DC offset signal being applied to 62-T2 by means of the resistor network shown. When the noise signal indicating fluttering yarn passing through the inlet eyelet is present, the Darlington pair formed of transistors 62-T2 and 62-T3 is biased to off or nonconducting condition. However, when the noise signal ceases, as a result of yarn breakage so that no fluttering yarn is passing between the light source 62-LED and the phototransistor 62-T1, the Darlington Pair 62-T2 and 62-T3 begins to conduct, drawing current which energizes the indicator light emitting diode 62-LED-1 and also provides an output signal on lead 62-0** to the conventional stop control for the beamer to cause the beamer to cease operation.

The power supply and tension command signals source 63 shown in FIG. 9 is similar to the power supply 55 shown in FIG. 7, and the step-down transformer indicated at 55-1, the rectifier bridge shown at 55-6 and the capacitor 55-C1 correspond to those of the power supply circuit of FIG. 7 and are indicated by corresponding reference characters. The unregulated 24 voltage supply on the lead 55-7 in the circuit of FIG. 9 is applied to the collector of the 2N3055 voltage regulator transistor 63-T1 which is connected in this embodiment, as shown, by connection from its collector to the collector of another transistor 63-T2 and across a resistor 63-R1 and Zener diode 63-Z to ground. The base of the transistor 63-T2 is connected to the bottom of the resistor 63-R1, and its emitter is connected through resistor 63-R2 to ground and to the base of the transistor 63-T1. This provides a regulated 24 volt supply on the lead 63-1 to provide a 24 volt regulated power supply to the components of the automatic tension control and stop motion circuits 61 and 62 of FIG. 8, and is also applied across a series network of resistors 63-R3, variable potentiometer 63-R4 which forms the tension set control, and fixed resistor 63-R5. The output lead 63-2 from the wiper of the tension set control potentiometer 63-R4 provides the tension command signal applied to the tension command input leads 61-1 of the FIG. 8 circuit.

We claim:

1. Yarn tensioning apparatus for tensioning a running length of yarn such as textile yarn or the like being drawn from a supply package for delivery at predetermined desired tension level to yarn utilization apparatus such as a beamer or the like, comprising an electronically controlled yarn tensioning device to be controlled by electrical signals from a remote control station and including a housing having yarn inlet and yarn outlet openings for passage of yarn therethrough along a predetermined yarn path, a first yarn tensioning station including a pair of aligned, spaced metallic pole pieces extending transversely within the housing perpendicularly intersecting the yarn path and defining a narrow gap for passage of the yarn through the gap, the pole pieces having shaped recesses therein adjacent the gap collectively defining a seat for a funnel member, a ceramic funnel member defining a truncated conical cavity opening toward the yarn outlet opening supported in said seat and a magnetic spherical ball member located in the truncated conical cavity, the funnel member being located relative to the yarn path so that the yarn extending along said path passes substantially horizontally below the ball member between said ball member and for confronting surface portion of the truncated conical cavity, an electromagnet coil structure within said housing magnetically linked with said pole pieces for generating magnetic flux to pass through the pole pieces and the gap therebetween exerting magnetic attractive forces on said ball member for varying attraction of the ball member toward the confronting surface portion of the funnel member along which the yarn passes and thereby varying tension of the yarn leaving the yarn tensioning device, and electronic control circuit means remote from said yarn tensioning device and electrically coupled to said electromagnet coil structure for regulating the electrical current supply to said coil structure and thereby regulating the magnetic forces exerted on said ball member.

2. Yarn tensioning apparatus as defined in claim 1, wherein said electromagnetic coil structure includes a pair of electromagnet coils of substantially cylindrical configuration having corresponding ends closely abutting and fixed to the pair of respective pole pieces and located in outwardly flanking relation to the yarn path extending from the inlet opening to the first yarn tensioning station formed by said ball member and funnel member.

3. Yarn tensioning apparatus as defined in claim 1, including a metallic pole member located upstream along the yarn path from said pair of pole pieces and extending transversely of the housing in intercepting relation to the yarn path and having an opening therethrough for passage of the yarn therethrough, and said electromagnet coil structure being fixed at one end to at least one of said pole pieces and at the other end to said last mentioned pole member.

4. Yarn tensioning apparatus as defined in claim 2, including a metallic pole member located upstream along the yarn path from said pair of pole pieces and extending transversely of the housing in intercepting relation to the yarn path and having an opening therethrough for passage of the yarn therethrough, and said pair of electromagnet coils each having one end thereof fixed in abutting relation against the respective pole pieces and having the opposite ends thereof fixed against said pole member.

5. Yarn tensioning apparatus as defined in claim 3, wherein the pole member located upstream along the yarn path from said pair of pole pieces also comprises a second yarn tensioning station including a pair of pole pieces of like configuration to the first mentioned pole pieces shaped to provide a seat for supporting a second funnel member and ball member located therein like the first mentioned funnel member and ball member to receive the yarn along a substantially horizontal path between the ball member and confronting funnel member surface portion associated with the pole pieces of the pole member near said inlet opening.

6. Yarn tensioning apparatus as defined in claim 5, wherein said pair of electromagnetic coils comprise a plastic spool wound with magnet wire and having a hollow bore extending therethrough parallel to the yarn path and a metallic cylindrical member extending through and filling the bore in each of the spools formed of the same material as said pole pieces and having the opposite ends of each intimately abutting and joined to a respective one of the pole pieces at said first and second yarn tensioning stations.

7. Yarn tensioning apparatus as defined in claim 5, including a plastic guide block spanning the major portion of the distance between said first and second yarn tensioning stations located between said pair of electromagnet coils and having a small diameter yarn passage extending therethrough for receiving yarn exiting from said second yarn tensioning station and providing a guide passage therefor extending to a location near said first yarn tensioning station.

8. Yarn tensioning apparatus as defined in claim 6, including a plastic guide block spanning the major portion of the distance between said first and second yarn tensioning stations located between said pair of electromagnet coils and having a small diameter yarn passage extending therethrough for receiving yarn exiting from said second yarn tensioning station and providing a guide passage therefor extending to a location near said first yarn tensioning station.

9. Yarn tensioning apparatus as defined in claim 8, wherein said plastic yarn guide block has a concave socket of near semicircular cross-section in a plane perpendicularly transverse to the yarn path and extending along a curved path opening through a face of the guide block normally facing upwardly in the position of normal use of the yarn tensioning apparatus to loosely capture the ball member of said second yarn tensioning station in its associated funnel member.

10. Yarn tensioning apparatus as defined in claim 1, wherein said electronic control circuit means includes transistor circuit means having an output terminal for providing output control signals for selected variable voltage levels to the associated electromagnet coil structure of a yarn tension device to be connected thereto and controlled thereby responsive to voltage levels applied to an input of the transistor circuit means for varying the magnetic force on the ball member of the associated yarn tensioning device to vary tension of the yarn leaving the same, a rectified DC voltage source, a manually adjustable potentiometer connected to said rectified DC voltage source and having a movable contact coupled to the input of transistor circuit means for applying voltages in accordance with the manual setting thereof to the transistor circuit means for varying the output voltages supplied to the associated electromagnet coil structure, and reset circuit for periodically supplying to the transistor circuit means reduced voltage levels below the voltage level of the potentiometer setting for periodically reducing the voltage level of the control signals applied to the electromagnet coil structure.

11. Yarn tensioning apparatus as defined in claim 10, wherein said transistor circuit means comprises a Darlington emitter-follower pair of transistors, resistor means coupling the base of a first one of the Darlington pair of transistors to the movable contact of said manually adjustable potentiometer, and a diode and manual switch coupling said base to said reset circuit.

12. Yarn tensioning apparatus as defined in claim 10, wherein said reset circuit is a degaussing circuit including an oscillator for producing a train of substantially square wave negative pulses and having a manually adjustable potentiometer coupled thereto for determining the pulse width of said pulses, transistor means for inverting and amplifying the pulse train output from said oscillator circuit to provide a negative reset pulse output of sufficient amplitude to return the voltage level at the input of said transistor circuit means to substantially 0 volts upon occurrence of each reset pulse regardless of the setting of the manually adjustable potentiometer connected to the input of said transistor circuit means.

13. Yarn tensioning apparatus as defined in claim 11, wherein said reset circuit is a degaussing circuit including an oscillator for producing a train of substantially square wave negative pulses and having a manually adjustable potentiometer coupled thereto for determing the pulse width of said pulses, transistor means for inverting and amplifying the pulse train output from said oscillator circuit to provide a negative reset pulse output of sufficient amplitude to return the voltage level at the input of said transistor circuit means to substantially 0 volts upon occurrence of each reset pulse regardless of the setting of the manually adjustable potentiometer connected to the input of said transistor circuit means.

14. Yarn tensioning apparatus as defined in claim 10, wherein said electronic control circuit means comprise a plurality of channels each having transistor circuit means and a potentiometer duplicating said first mentioned transistor circuit means and said mutually adjustable potentiometer to provide output signal voltage levels to the electromagnet coils of a plurality of said yarn tension devices for each channel, the manual adjustable potentiometer for each channel being operative to set the output control signal voltage level to be applied to the electromagnet coils of the plurality of yarn tensioning devices associated with the respective channel, and means for selectively applying reset signals from said reset circuit to each of the channels during manual adjustment of the potentiometer setting therefor to minimize residual magnetic effects in the associated yarn tension devices during reduction of the voltage level being applied thereto.

15. Yarn tensioning apparatus as defined in claim 11, wherein said electronic control circuit means comprises a plurality of channels each including a Darlington pair of transistors coupled through a diode and manual switch to said reset circuit and forming a transistor circuit and adjustable potentiometer duplicating said first mentioned transistor circuit means and manually adjustable potentiometer to provide output signal voltage levels to the electromagnet coils of a plurality of said yarn tension devices for each channel, the manual adjustable potentiometer for each channel being operative to set the output control signal voltage level to be applied to the electromagnet coils of the plurality of yarn tensioning devices associated with the respective channel, and means for selectively applying reset signals from said reset circuit to each of the channels during manual adjustment of the potentiometer setting therefor to minimize residual magnetic effects in the associated yarn tension devices during reduction of the voltage level being applied thereto.

16. Yarn tensioning apparatus as defined in claim 12, wherein said electronic control circuit means comprise a plurality of channels each having transistor circuit means and a potentiometer duplicating said first mentioned transistor circuit means and said manually adjustable potentiometer to provide output signal voltage levels to the electromagnet coils of a plurality of said yarn tension devices for each channel, the manual adjustable potentiometer for each channel being operative to set the output control signal voltage level to be applied to the electromagnet coils of the plurality of yarn tensioning devices associated with the respective channel, and means for selectively applying reset signals from said reset circuit to each of the channels during manual adjustment of the potentiometer setting therefor to minimize residual magnetic effects in the associated yarn tension devices during reduction of the voltage level being applied thereto.

17. Yarn tensioning apparatus as defined in claim 13, wherein said electronic control circuit means comprises a plurality of channels each including a Darlington pair of transistors coupled through a diode and manual switch to said reset circuit and forming a transistor circuit and adjustable potentiometer duplicating said first mentioned transistor circuit means and manually adjustable potentiometer to provide output signal voltage levels to the electromagnet coils of a plurality of said yarn tension devices for each channel, the manual adjustable potentiometer for each channel being operative to set the output control signal voltage level to be applied to the electromagnet coils of the plurality of yarn tensioning devices associated with the respective channel, and means for selectively applying reset signals from said reset circuit to each of the channels during manual adjustment of the potentiometer setting therefor to minimize residual magnetic effects in the associated yarn tension devices during reduction of the voltage level being applied thereto.

* * * * *